US006634997B2

(12) United States Patent
Breibart et al.

(10) Patent No.: US 6,634,997 B2
(45) Date of Patent: Oct. 21, 2003

(54) PILATES EXERCISE APPARATUS

(75) Inventors: Joan Breibart, 1807 Second St., Suite 40, Santa Fe, NM (US) 87505; Robert Berg, Lomita, CA (US)

(73) Assignee: Joan Breibart, New York, NY (US)

( * ) Notice: Subject to any disclaimer, the term of this patent is extended or adjusted under 35 U.S.C. 154(b) by 148 days.

(21) Appl. No.: 10/050,071

(22) Filed: Oct. 23, 2001

(65) Prior Publication Data

US 2003/0078143 A1 Apr. 24, 2003

(51) Int. Cl.[7] ..... A63B 21/04
(52) U.S. Cl. ..... 482/130
(58) Field of Search ..... 482/130, 142, 482/136, 135, 137, 123, 129; D21/191; 601/56; 297/423.41, 461

(56) References Cited

U.S. PATENT DOCUMENTS

D237,634 S * 11/1975 Ricketts ..... 482/137
4,448,412 A * 5/1984 Brentham ..... 482/130
5,002,271 A * 3/1991 Gonzales ..... 482/130
5,387,171 A * 2/1995 Casey et al. ..... 452/130
5,403,258 A * 4/1995 Hill ..... 606/240
5,616,109 A * 4/1997 Szu-Ming ..... 482/123
5,653,667 A * 8/1997 Reyes ..... 482/121

* cited by examiner

*Primary Examiner*—Jerome W. Donnelly
(74) *Attorney, Agent, or Firm*—R. Neil Sudol; Henry Coleman; William Sapone

(57) ABSTRACT

The present invention is an improved Pilates chair having a seat top with an underside, a base that is wider than the seat top, a plurality of bracing members between the seat top and the base, a swingable lever having an upper end and a lower end disposed between the seat top and the base, the lower end being hingeably attached from the base, an adjusting block disposed slidably along the lever between the upper and lower ends thereof, means on the adjusting block for locking it in a position along the lever, and one or more elongated helical springs each having two ends, one of the ends being attached from the underside of the seat top, and the other end being attached from the adjusting block, whereby sliding said adjusting block along said lever, and locking it in a position therealong, will result in a greater or lesser extent of stretch being imparted to the at least one helical spring.

5 Claims, 2 Drawing Sheets

PILATES EXERCISE APPARATUS

FIELD OF THE INVENTION

Figure 1:
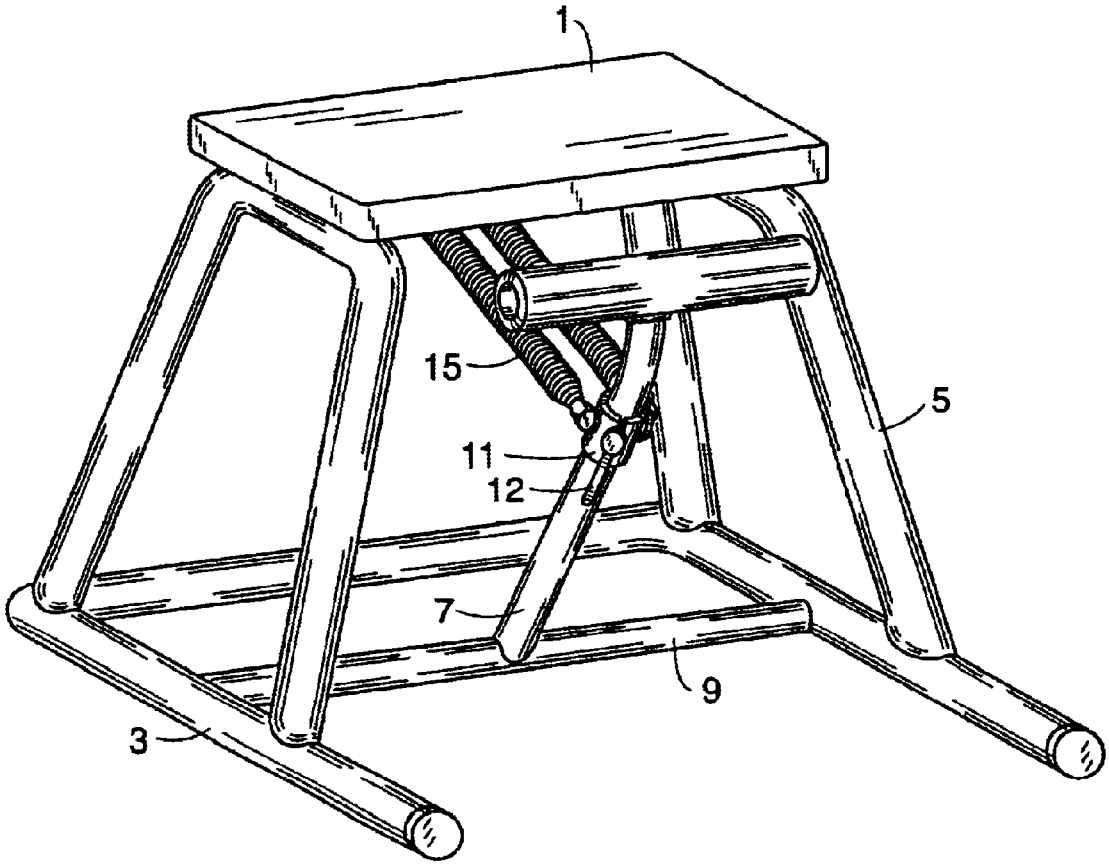

The present invention relates to exercise apparatus employing the exercise method developed by Joseph H. Pilates.

BACKGROUND

The exercise method developed by Joseph H. Pilates involves some principles known from yoga, and hundreds of excises utilizing a wide variety of specially designed equipment employing a fusion of various philosophies of body culture, movement, body mechanics, balance, coordination, positioning, strength and flexibility, aiming at improved fitness, enhanced performance, and improved posture and flexibility with low impact. One device best known from the Pilates variety of devices, is the "reformer" which employs spring tension exerted on a movable carriage. The various Pilates devices make extensive use of helical springs which were deemed by the designer to be preferable over other resistance elements due to their linear resistance loading characteristics as a function of the spring extension.

One of the Pilates-designed exercise devices became known as the "wunda chair" or "Pilates chair." This is in its original form a body rebalancing device made from two plywood sides, with a pedal between them and hinged from the base, and attached to the rear edges of the plywood sides by a plurality of elongated, usually up to about 6 helical springs. These springs resiliently connect the hinged pedal from the fixed plywood sides, and are provided with large eyes at their respective ends through which the springs are hooked at various stretched positions to permit a variation of their biasing strengths.

There are various exercise machines known from the prior art, such as those described in U.S. Pat. Nos. 4,641,833 and 5,897,459. These are designed for repetitive exercise movements against variable resistances. These are not Pilates type devices, and their use generally results in an increased imbalance between the parts of the body. The Pilates exercises and devices are designed to correct such imbalances caused by other types of conventional exercise machinery.

The Pilates chair can be sat in when it is turned upside down, and in all of its various possible positions can support body movements when the user is standing, sitting, kneeling, bending, supine or prone. In any of these positions the user places any part of its body onto the bar connecting the hinged pedal element and hinges the spring-biased bar against the biasing effect of the springs, as they can be adjusted on the hooked attachment of the springs. Changing the spring tension is complicated and involves a great deal of practice and often more strength than the user can readily muster. Furthermore, each exercise tends to require a different spring tension adjustment. The Pilates chair in its original form is not structurally sound. The springs can become easily de-tached from the sidewalls of the chair and also tend to knock against them. While the spring resistance and the corresponding of the "difficulty" of the exercises can be compensated by the appropriate repetitions and use of the Pilates exercise method, an improvement of the design of the Pilates chair has become overdue.

BRIEF DESCRIPTION OF THE INVENTION

The present invention is an improved Pilates chair having a seat top with an underside, a base that is wider than the seat top, a plurality of bracing members between the seat top and the base, a swingable lever having an upper end and a lower end disposed between the seat top and the base, the lower end being hingeably attached from the base, an adjusting block disposed slidably along the lever between the upper and lower ends thereof, means on the adjusting block for locking it in a position along the lever, and one or more elongated helical springs each having two ends, one of the ends being attached from the underside of the seat top, and the other end being attached from the adjusting block, whereby sliding said adjusting block along said lever, and locking it in a position therealong, will result in a greater or lesser extent of stretch being imparted to the at least one helical spring.

BRIEF DESCRIPTION OF THE INVENTION

Figure 2:
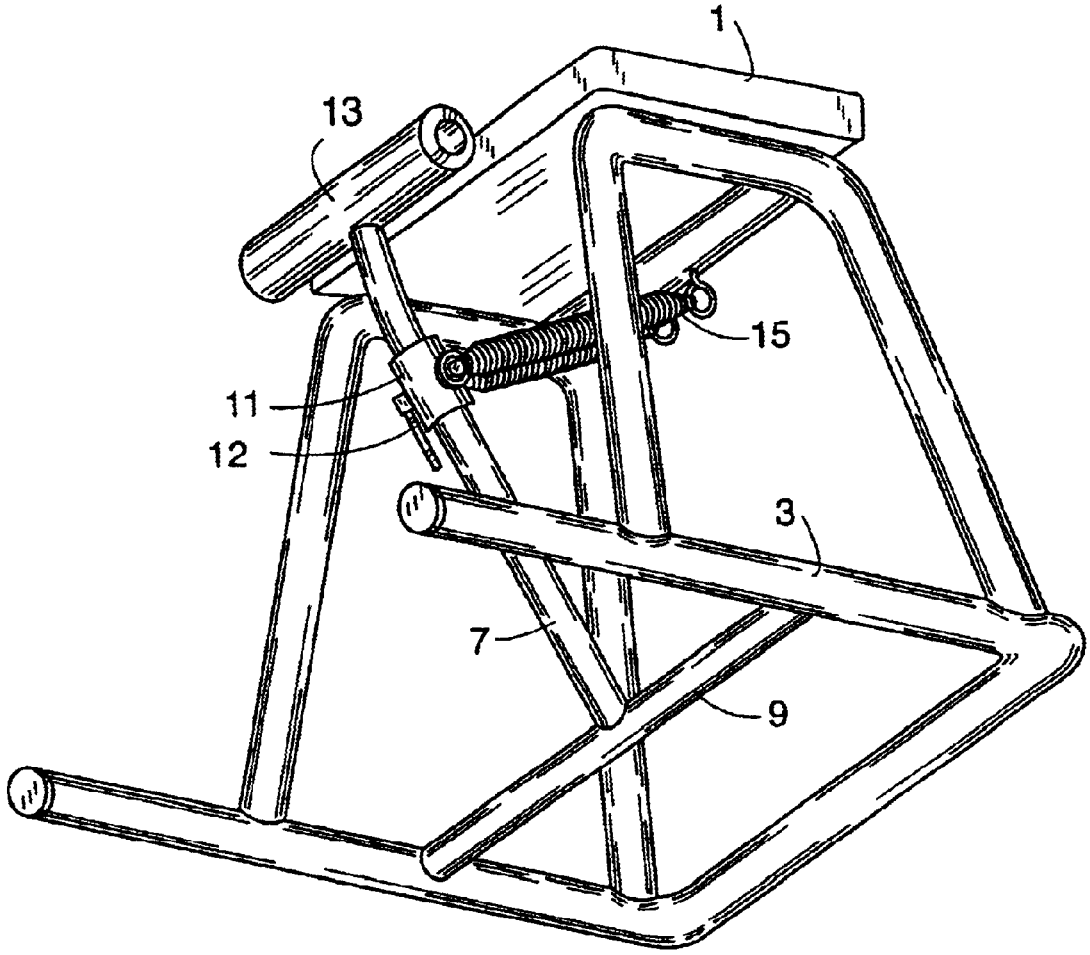

The present invention is described in greater detail with reference being had to the drawing, wherein FIGS. 1 and 2 are different perspective views of the improved Pilates chair of the present invention.

DETAILED DESCRIPTION

As shown in the two different perspective views of FIGS. 1 and 2, the improved Pilates chair of the present invention has a seat 1 which is suitably upholstered with a washable plastic cover. The illustrated embidoment of the chair has a tubular structure having a base that is wider than the seat 1. The tubular base 3 is connected from the seat through tubular supports 5.

The movable part of the improved chair of the present invention is a lever 7 with a pedal 13 at its upper end. The pedal 13 is suitably also upholstered or cushioned for the user's comfort. The bottom of the lever 7 is hingeably attached to the base 3 through a cross member 9.

A sleeve 11 is slidably mounted from the lever 7. The sleeve suitably does not fully encircle the tubular lever 7, and a locking arm 12 is provided to tighten the sleeve at any location on the lever 7. In the illustrated embodiment of the improved Pilates chair of the present invention two helical springs 15 are attached at one of their ends to the underside of the seat 1. The other ends of the springs 15 are attached to opposed sides of the sleeve 11. Thus, when the sleeve is slid along the length of the lever 7, and locked in position thereon, the helical springs are thereby tightened or loosened, depending on the location of the sleeve 11 on the lever 7.

The improved Pilates chair of the present invention can be used in any convenient manner in which the original, old-fashioned Pilates chairs of the prior art were used. However, this chair is specifically designed to continue and maintain balance between the parts of the body, while at the same time provide a design that is lighter, more stable on the floor, and allows a simple effortless change of extent of spring extension depending on the location of the sleeve 11 along the lever 7. Thus this design greatly increases the chair's usefulness in doing Pilates exercises. It allows the chair to be easily stored and moved from place to place, and to provide increased support while exercising, and allows easy and rapid adjustments in the difficulty of the exercises by effortless changing of spring tension.

I claim:

1. An improved Pilates chair which comprises (i) a seat top having an underside, (ii) a base that is wider than said seat top, (iii) a plurality of bracing members between said seat top and said base, (iv) a swingable lever having an upper end and a lower end disposed between said seat top and said base, said lower end being hingeably attached from said base, (v) an adjusting block disposed slidably along said lever between said upper and lower ends thereof, (vi) means on said adjusting block for locking it in a position along said lever, and (vii) one or more elongated helical springs each having two ends, one of said ends being attached from the underside of said seat top, and the other of said ends being attached from said adjusting block, whereby sliding said adjusting block along said lever, and locking it in a position therealong, will result in a greater or lesser extent of stretch being imparted to said at least one helical spring.

2. The improved Pilates chair of claim 1, wherein said one or more helical springs are two helical springs.

3. The improved Pilates chair of claim 1, wherein said adjusting block is a sleeve slideable along said lever, and said means for locking said adjusting block is a locking arm for tightening said sleeve at any position along said lever.

4. The improved Pilates chair of claim 3, wherein said other ends of said springs are attached from said sleeve.

5. The improved Pilates chair of claim 3, wherein said base and said bracing members are tubular metal members.

* * * * *